US006430761B1

(12) United States Patent
Brandorff et al.

(10) Patent No.: US 6,430,761 B1
(45) Date of Patent: Aug. 13, 2002

(54) COMPACT PORTABLE PATIENT LIFT

(75) Inventors: Alexander Brandorff, New Milford; Gerard Michael Campbell, Mansfield Center, both of CT (US)

(73) Assignee: Take-Along Lifts LLC, New Milford, CT (US)

( * ) Notice: Subject to any disclaimer, the term of this patent is extended or adjusted under 35 U.S.C. 154(b) by 0 days.

(21) Appl. No.: 09/484,559

(22) Filed: Jan. 18, 2000

Related U.S. Application Data

(60) Provisional application No. 60/117,212, filed on Jan. 25, 1999.

(51) Int. Cl.[7] ..... A61G 7/10

(52) U.S. Cl. ..... 5/86.1; 5/81.1 R

(58) Field of Search ..... 5/81.1 R, 83.1, 5/86.1; 280/304.1, 288.4

(56) References Cited

U.S. PATENT DOCUMENTS

| | | | | | |
|---|---|---|---|---|---|
| 2,539,346 | A | * | 1/1951 | Feist | 5/86.1 |
| 2,962,730 | A | | 12/1960 | Carnes | |
| 3,137,011 | A | | 6/1964 | Fischer | |
| 3,222,029 | A | * | 12/1965 | Hildemann | 5/86.1 |
| 3,914,808 | A | | 10/1975 | Woods | |
| 3,940,808 | A | | 3/1976 | Petrini | |
| 4,157,593 | A | | 6/1979 | Kristensson | |
| 4,288,124 | A | | 9/1981 | Hamilton | |
| 4,399,572 | A | | 8/1983 | Johansson | |
| 4,435,863 | A | | 3/1984 | Lerich | |
| 4,510,633 | A | | 4/1985 | Thorne | |
| 4,545,085 | A | * | 10/1985 | Feldt | 5/86.1 |
| 4,704,749 | A | | 11/1987 | Aubert | |
| 4,719,655 | A | | 1/1988 | Dean | |
| 4,737,997 | A | | 4/1988 | Lamson | |
| 4,805,248 | A | | 2/1989 | Lunau | |
| 4,999,862 | A | | 3/1991 | Hefty | |
| 5,060,960 | A | | 10/1991 | Branscumb | |
| 5,153,953 | A | | 10/1992 | Sumrall | |
| 5,233,708 | A | | 8/1993 | Winston | |
| 5,319,817 | A | | 6/1994 | Hay | |
| 5,520,403 | A | | 5/1996 | Bergstrom | |
| 5,560,054 | A | | 10/1996 | Simon | |
| 6,161,232 | A | * | 12/2000 | Von Schroeter et al. | 5/86.1 |

OTHER PUBLICATIONS

Arjo, Advertisement, (Date unknown).

* cited by examiner

*Primary Examiner*—Lynne H. Browne
*Assistant Examiner*—Fredrick Conley

(57) ABSTRACT

An improved portable patient transfer device comprising a small wheeled base having a vertically disposed telescoping lifting column extending upwardly therefrom. A patient support means extends from the column to support the patient. A crank, accessible to both patient and attendant, is used to raise and lower the lifting column for transfer between surfaces with different heights, such as beds, wheelchairs, and car seats. The lift my be closed and temporarily attached to a wheelchair for convenient transport with a patient. The lift is small and lightweight and may be easily transported and stored. The lift is further economical to manufacture.

4 Claims, 11 Drawing Sheets

COMPACT PORTABLE PATIENT LIFT

This application claims the benefit of Provisional Patent Application 60/117,212 filed Jan. 25, 1999.

BACKGROUND—Field of Invention

This invention relates to patient transfer and lifting devices.

BACKGROUND—Description of Prior Art

There is a need for a compact, lightweight and easily portable patient transfer device to assist caregivers in transferring patients between beds, wheelchairs, cars, etc.; for use in the home, in institutional settings, and in the outside world. Transferring of disabled patients is a leading cause of injury in the health-care industry, with the nursing occupation having among the highest incidence of back injury, despite the prior art and the availability of commercial patient lifts. These lifts are under-utilized for a number of reasons, such as restricted space in many hospital wards and bathrooms, cumbersome operating requirements, the indignity involved in the mode of transport, the additional time required for performing the transfer, and the unavailability of the lift at both the patient's starting and destination locations. A device is required that can work in confined spaces, is simple to set up and use, feels safe, secure and is not intimidating for the patient, and can be transported with the patient.

The problem is pervasive in the home health care industry as well, where spaces are not designed for safe patient transfers, and the caregiver is often alone and has no help during lifts. Since lifts are available in less than 10 percent of the homes visited by home health care professionals, a device that can be easily brought from home to home is also required.

In addition, many patients are essentially home-bound due to the unavailability of a conveniently portable lift, reducing their quality of life unnecessarily. A device is required that would allow a single, and often elderly, spouse to bring their disabled spouse out of the house, on car trips, cruises, etc. The device must be versatile and be able to maneuver in the confined spaces found in many homes and public accommodations. It must also be easily transported, and must transfer patients in a dignified manner if it is to be used outside the home.

While this field contains considerable prior art, these devices have proven inadequate. U.S. Pat. No. 4,805,248 to Lunau (1989) is typical of ceiling-mounted patient lifts. While effective, these are limited to use in very well defined areas. U.S. Pat. No. 3,137,011 to Fischer (1964) is representative of a common type of mobile patient lift. A major disadvantage of this design is that the patients are essentially suspended from a hook. The resultant swaying motion during transfer is disconcerting to most patients. In addition, the patient is transported in a partially reclined position, increasing their sense of helplessness and indignity, particularly if used outside in public. U.S. Pat. No. 4,399,572 to Johansson (1983) overcomes the swaying problem by using short straps attached to a rigid seat, for side-loading into a car. The rigid seat presents a difficulty in terms of initially placing the seat under the patient. Additionally, this patent teaches the use of a wide base to surround the wheelchair, making it inoperable in confined spaces. Additionally, the side-loading design prevents the lift from being used on both sides of the vehicle. U.S. Pat. No. 3,914,808 to Woods (1975) teaches the use of a short flexible sling in a front-loading orientation, with a pivoting column. Here again, the base must be relatively wide in order to avoid tipping as the column is rotated, and there is no means for compactly transporting or storing the lift. Additionally, the use of a fixed length sling requires that the patient be sitting precisely on the center of the sling, to avoid tipping the patient as the column is raised. This increases the time and training required to use the lift. U.S. Pat. No. 3,940,808 to Petrini (1976) similarly describes a pivoting column, necessitating a relatively wide base, and a rigid seat, complicating the placement of the sling on the patient. U.S. Pat. No. 4,719,655 to Dean (1988) describes a lift used with a short sling in a front-facing orientation, the sling being adjustable using straps and buckles. However, this lift cannot be rolled once the patient is raised, since the jack is then resting on the floor. It also requires that a separate back support be installed. U.S. Pat. No. 2,962,730 to Carnes (1960) and U.S. Pat. No. 2,539,346 to Feist (1951) describe a lift used with a fixed-length sling having no integral back support, and having no means of compactly transporting or storing the lift. U.S. Pat. No. 4,737,997 to Lamson (1988) features a narrow base. The two-wheel design of this lift would be too unstable to safely support a patient, however. It also is limited to a narrow range of lifting heights. U.S. Pat. No. 4,704,749 to Aubert (1987) describes a lift intended to allow a partially disabled patient to transfer themselves, without the need for a health care provider. A limitation of this design is that the patient's weight is supported under the arms, which tends to be unnatural and uncomfortable and requires a significant amount of shoulder strength. It is therefore appropriate for a relatively small percentage of patients, and is also relatively expensive. U.S. Pat. No. 4,435,863 to Lerich describes a transporting device consisting of a pivoting chest pad to which the patient is strapped. Pivoting the pad causes the patient to be pivoted out of a seat. He is then transferred in a bent-over orientation and pivoted down onto a receiving surface. This design results in an undignified transfer position, and is fairly limited in terms of the difference in height between initial and final surfaces. It also results in part of the weight being carried on the patient's chest, making it inappropriate for patients with breathing difficulty, who use ventilators or who wear cervical spine stabilization devices. U.S. Pat. No. 4,510,633 to Thorne (1985), and U.S. Pat. No. 5,233,708 to Winston (1993) are similar in that the patient is strapped to a rolling frame with their knees supporting part of the load. The range of transfer surface heights is relatively limited since the patients feet cannot leave the floor level. U.S. Pat. No. 4,157,593 to Kristensson (1979) and U.S. Pat. No. 4,545,085 to Feldt (1985) overcome this latter limitation by raising a separate sub-frame, at the expense of additional weight and complexity. They all require that a patient be strapped into the device, a somewhat undignified posture when used in public. In addition, they all require that the patient's knees be bent 90 degrees, making it unsuitable for amputees, individuals with arthritis or leg injuries, a large proportion of the individuals who would be in need of assistance.

In addition, none of the previously mentioned patents adequately address the issue of portability. U.S. Pat. No. 5,153,953 describes a lift which must be disassembled for transport. In addition, the individual pieces are relatively large and cumbersome. The base must be large enough to surround a wheelchair, and the column does not telescope, so it must be tall enough to accommodate the maximum lift height. U.S. Pat. No. 5,560,054 to Simon (1996) describes a folding lift design to minimize storage space. Even when folded, however, this lift is quite large due to its overhead boom design, and certainly not readily transportable. It also shares the problems associated with dangling from a hook described previously. In addition, the method of folding the legs vertically, in the direction of the applied load, represents a potentially dangerous failure mode should the highly loaded locking mechanism fail while transferring a patient. U.S. Pat. No. 5,319,817 to Hay (1994) describes a gurney with folding legs and transport surface, so as to occupy less aisle space when stored. The folding mechanism is relatively complex, however, and it is not useful for transferring patients to wheelchairs or cars. Arjo, Inc. (Morton Grove, Ill.) markets a patient lift whose legs fold upward for portability and compact storage. However, their lift is too heavy to be lifted by most individuals, and it cannot be transported on the back of a wheelchair. As noted above, the method of folding the legs vertically presents a potential safety problem should the legs not properly lock during use. U.S. Pat. No. 6,161,232 to Vos Schroeter (2000) describes an overhead lift from which a patient is suspended. While the width can be narrowed to pass through doorways, the length remains the same, and its height is inherently large due to its overhead design. In addition, the requirement for two parallel drives make it inherently expensive, heavy, and non-portable. U.S. Pat. No. 3,222,029 to Hildemann (1965) presents a lift who's width can be narrowed for storage. However, the device suspends the patient from a hook, with the attendant swaying problems noted above. In addition, the lift can only roll freely when fully open, since the wheels will only pivot freely when the caster's swing axis is perpendicular to the floor.

None of the previous patents address the problem of insuring that a lift is available at both the patient's starting and final locations. U.S. Pat. No. 4,999,862 to Hefty (1991) attempts to address this by incorporating an overhead crane onto a wheelchair. This approach suffers from the limitations of being relatively complex and expensive, and requires modification of the wheelchair. U.S. Pat. No. 5,520,403 to Bergstrom (1996) and U.S. Pat. No. 5,060,960 to Branscumb (1991) also require customized wheelchairs. U.S. Pat. No. 4,288,124 to Hamilton (1981) presents a transfer stool that can be mounted to a standard wheelchair with minimum modification. It does not provide for patient support during transfer to the stool, however, and can not be used to transfer between different height surfaces.

OBJECTS AND ADVANTAGES

Accordingly, several objects and advantages of the present invention are:

(a) to provide a lift that can be used in confined spaces;

(b) to provide a lift that is easily transportable between locations;

(c) to provide a lift that transports patients in a natural, comfortable and dignified posture;

(d) to provide a lift that is easy to use;

(e) to provide a lift that feels secure and is not intimidating to the patient;

(f) to provide a lift that provides for faster patient transfers;

(g) to provide a lift that requires minimal effort by a single care provider;

(h) to provide a lift that can be mounted on a standard wheelchair so as to be readily available at both starting and destination locations;

(i) to provide a lift that allows the patient the opportunity to participate is his transfer;

(j) to provide a lift that is versatile and adaptable to a variety of settings;

(k) to provide a lift that can be placed into a car trunk without disassembly;

(l) to provide a lift that provides support for the patient during transfer;

(m) to provide a lift that is economical to manufacture;

(n) to provide a lift that is compact and lightweight;

(o) to provide a lift that can be stored in confined spaces;

(p) to provide a lift that can be used to transfer patients between different height surfaces such as beds, wheelchairs, chairs and cars.

Further objects and advantages of this invention will become apparent from a consideration of the drawings and ensuing description.

DESCRIPTION OF DRAWINGS

In the drawings, closely related figures have the same number but different alphabetic suffixes.

REFERENCE NUMERALS IN DRAWINGS

10—lift
20—base
21—right leg support
22—telescoping right leg
23—left leg support
24—left leg
26—base axis
27—right leg
30—front casters
32—rear casters
34—fold axis pin
36—locking pin
37—snap button
38—locking hole
40—lifting column
41—gas spring
42—lifting screw
43—nut
44—inner column
45—mounting pins
46—outer column
47—bearings
48—crank
49—brake

60—top section
62—arms
64—handlebar
65—fittings
67—locating pin
68—handle
72—crossbar
74—patient support connectors
76—pillow block bearing
100—"seat" sling
102—sling cloth
103—loops
104—sling straps
106—hooks
108—back strap
110—"two-piece" patient support
112—thigh support
114—thigh support strap
116—back support
132—foot pedal
134—linkage
200—wheelchair
210—wheelchair handgrips

SUMMARY

In accordance with the present invention a compact, foldable and affordable patient lift that is easily transportable and simple and fast to use, and that transfers the patient in a dignified and comfortable manner.

Description of Preferred Embodiment—FIGS. 1, 2, 3, 5, 7

Figure 1A:
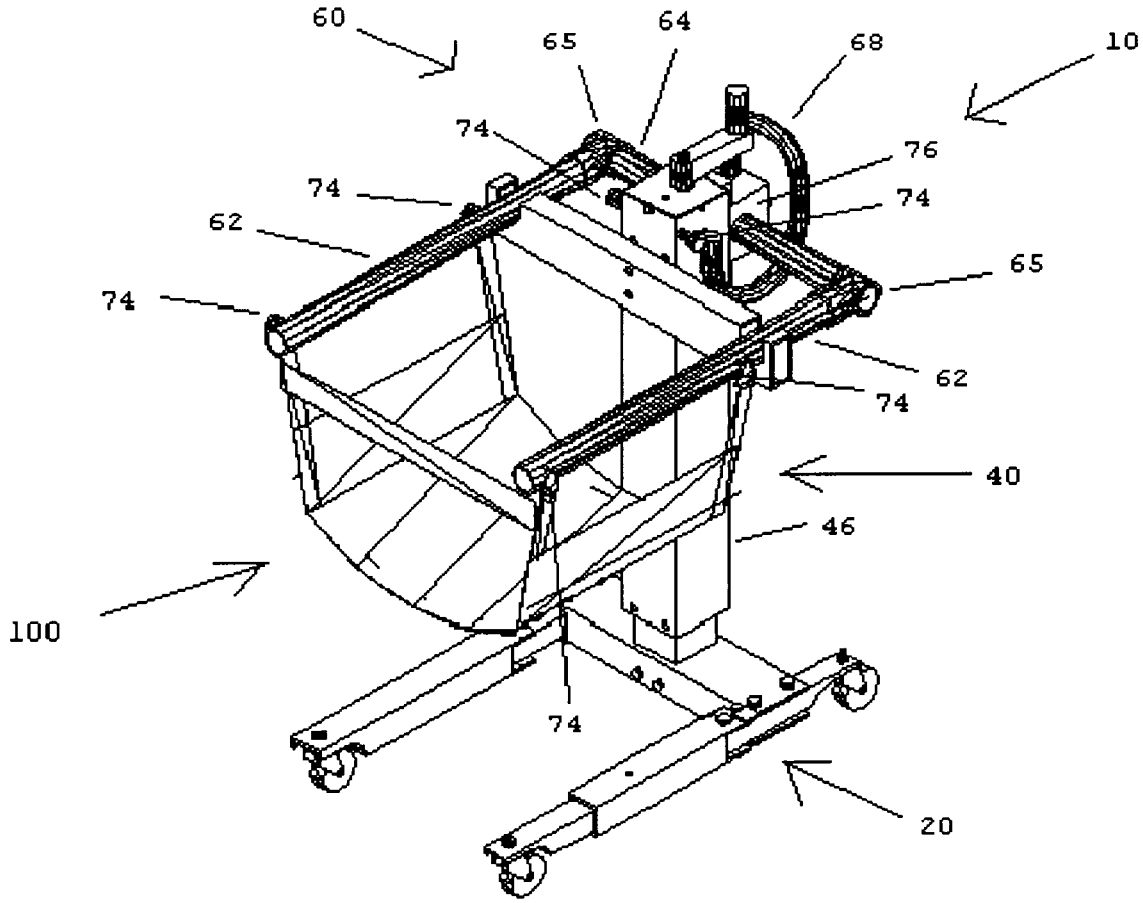
FIG. 1A is a perspective view of the invention with the "seat" type sling attached.

A preferred embodiment of the lift of the present invention is illustrated in perspective view in FIGS. 1A through 1D, Referring to FIG. 1A, lift 10 is comprised of the following subassemblies: a base 20, a lifting column 40, a top section 60, and a sling 100.

Figure 1B:
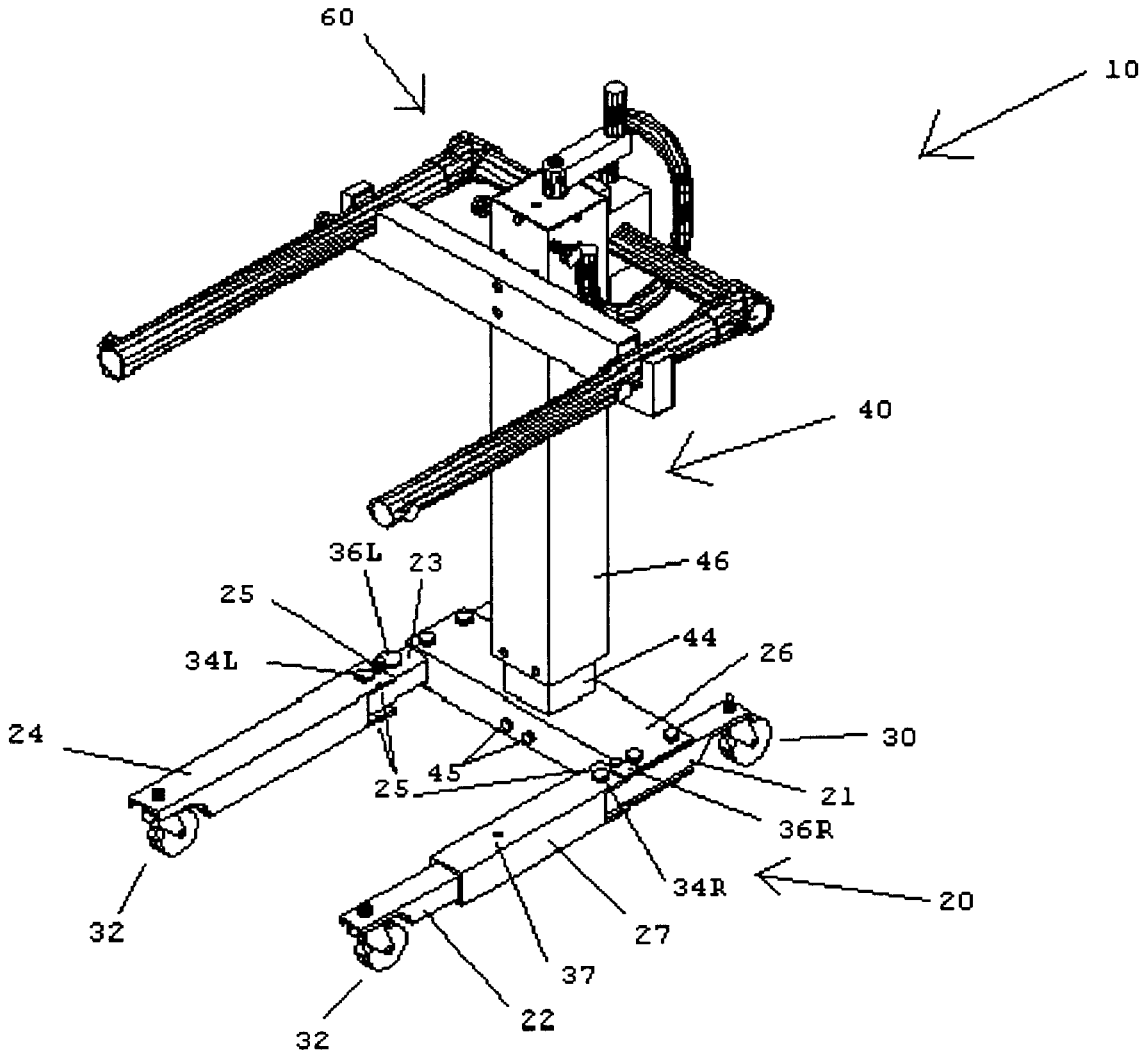
FIG. 1B is a perspective view of the invention.

Referring now to FIG. 1B, the base 20 is formed of a base axis 26, preferably a rectangular thin wall tube of 4 in×2 in×⅛ wall aluminum, to which are bolted a right leg support 21 and a left leg support 23, also preferably aluminum. Front casters 30 attach to the underside of right leg support 21 and left leg support 23. Left leg 24, a preferably square tube of 2 in×5/16 wall aluminum, attaches to left leg support 23 by means of a fold axis pin 34L. A thrust washer (not shown), preferably of oil-impregnated bronze, is placed on both top and bottom of left leg support 23, providing a bearing surface to facilitate pivoting left leg 24 about fold axis pin 34L. A locking pin 36L runs through a hole in left leg support 23 and mates with one of the locking grooves 25 in left leg 24. Locking pin 36 preferably consists of a pin of the type having a spring-loaded ball at its tip that keeps the pin in place during use, but that can be readily extracted by pulling the ring at the top of the pin. Rear caster 32 mounts to the underside of left leg 24.

Similarly, right leg 27, of similar construction to left leg 24, attaches to right leg support 21, using fold axis pin 34R and thrust washers as described above. A locking pin 36R runs through a hole in right leg support 21 and mates with one of the locking grooves 25 in right leg 27. A telescoping leg 22, a preferably square tube of 1½ in×⅛ in wall aluminum, is slide-ably connected to right leg 27. Thin strips of sliding material, preferably PTFE, approximately 1.5 in wide, 5 inches long and ⅛ in thick, are adhered to each side of telescoping leg 22. These provide a sliding surface to facilitate sliding telescoping leg 22 into right leg 27. A snap button 37 is mounted inside telescoping leg 22, the button extending up through a locking hole 38 in right leg 27.

Figure 2:
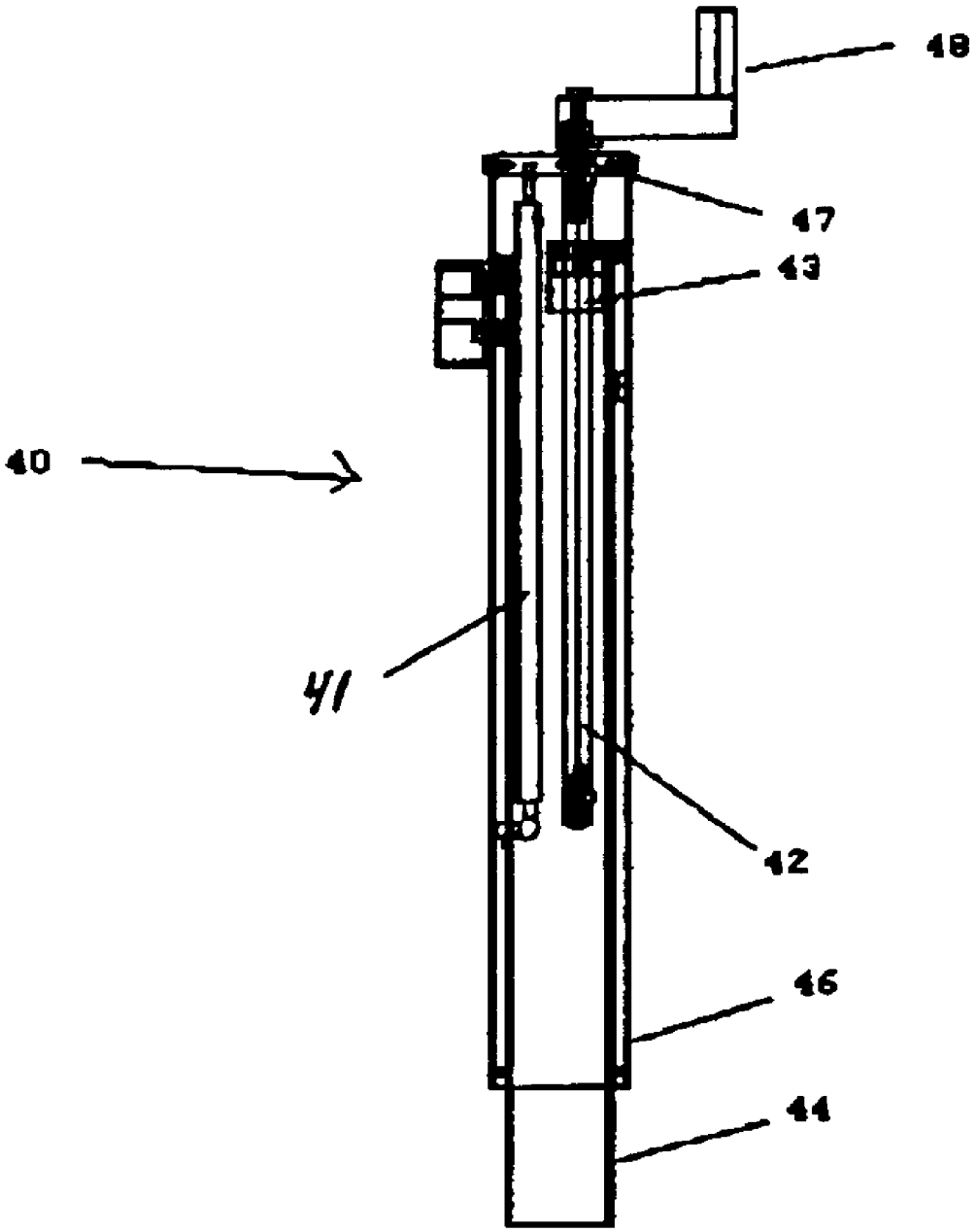
FIG. 2 is a side cross-sectional view of the lifting column.

Lifting column 40 consists of an inner column 44 and an outer column 46. Inner column 44, preferably a 3 in square tube of ⅛ in wall aluminum, mounts into a preferably square opening in base axis 26, and is held in place by mounting pins 45. Mounting pins 45 are preferably of similar construction to locking pins 36 described above. Thin strips of sliding material, preferably PTFE, approximately 3 in wide, 12 inches long and ⅛ in thick, are adhered to each side of inner column 44 at its top end. These provide a sliding surface to facilitate telescoping outer column 46 over inner column 44. Outer column 46 is preferably constructed of 4 in×⅛ in wall aluminum tubing. Referring now to FIG. 2, a lifting screw 42 is shown mounted inside telescoping column 40. The lifting screw, preferably an acme screw of ¾ diameter and ⅓ in lead, runs through nut 43, which is rigidly mounted at the top of inner column 44. The top of the lifting screw is held in place by bearings 47, which are mounted to the top of outer column 46. A crank 48 is attached to the top of lifting screw 42. A counterbalance spring, preferably a gas spring 41, is mounted in parallel with lifting screw 42. The bottom of the counterbalance spring is attached to inner column 44, and the top of counterbalance spring is attached to outer column 46. Referring now to FIG. 1A, top-section 60 contains a pillow block bearing 76, preferably of UHMW Polyethylene, that mounts to the front side of outer column 46. A handlebar 64, preferably constructed of 1¼ in aluminum pipe, passes through pillow block 76. A spring-loaded locating pin 67 (visible in FIG. 7), preferably a hand spring plunger, may mate with a hole in handlebar 64, preventing it from rotating when its' pin mates with the hole in the handlebar. Arms 62, preferably of 1¼ in aluminum pipe, attach to the ends of handlebar 64 by means of fittings 65. Patient support connectors 74 are mounted to the sides of arms 62 and to the top of outer column 46 and serve as attachment points for seat sling 100 or other sling types as will be described later. Crossbar 72, preferably constructed of 2½ in×1½ in×⅛ wall rectangular aluminum tubing, is bolted to the rear side of outer column 46, and supports arms 62 when the top-section 60 is in the open position as shown. Handle 68 mounts to outer column 46.

Figure 3:
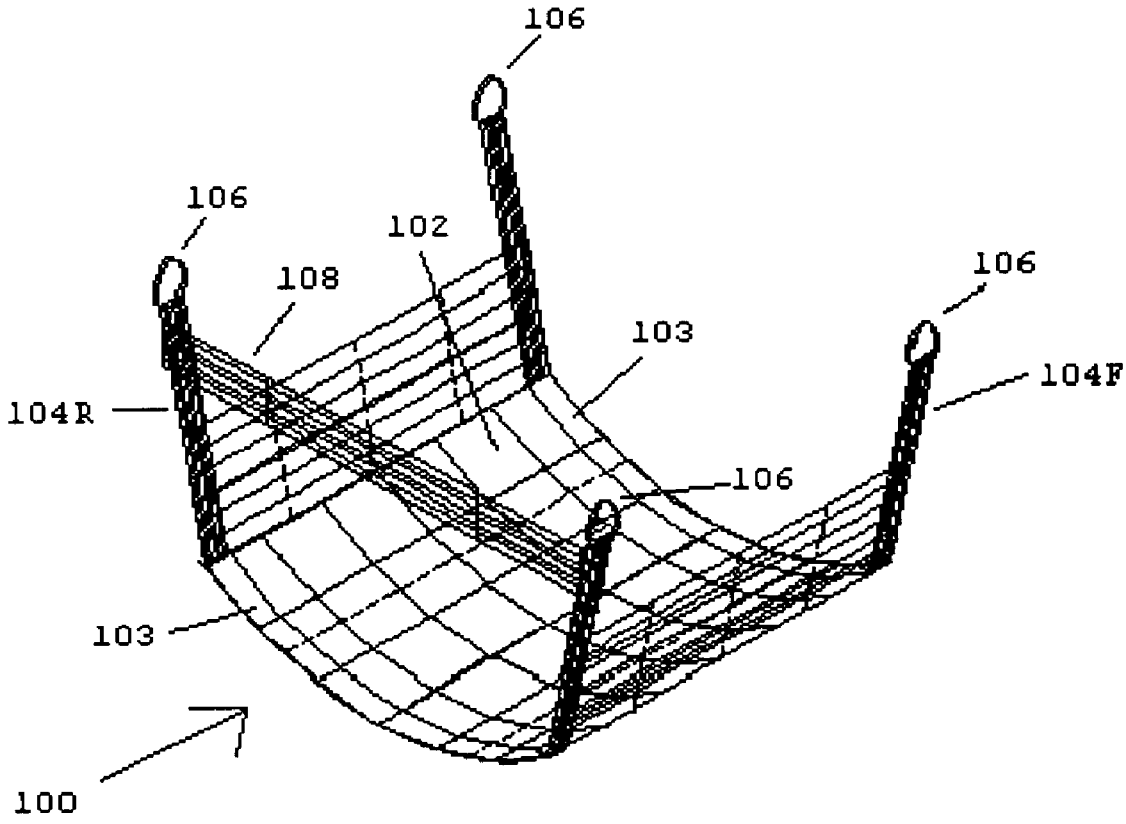
FIG. 3 is a perspective view of the "seat" type sling.

Referring now to FIG. 3, which shows a perspective view of the seat sling 100 , which is comprised of a rectangular-shaped sling cloth 102. Loops 103 are sewn along the two long edges of sling cloth 102. A sling strap 104 is passed through each loop 103, such that the straps can slide freely within these slots. Hooks 106 are sewn onto the ends of sling straps 104. A back strap 108 is sewn onto the rear sling strap 104R.

Figure 5:
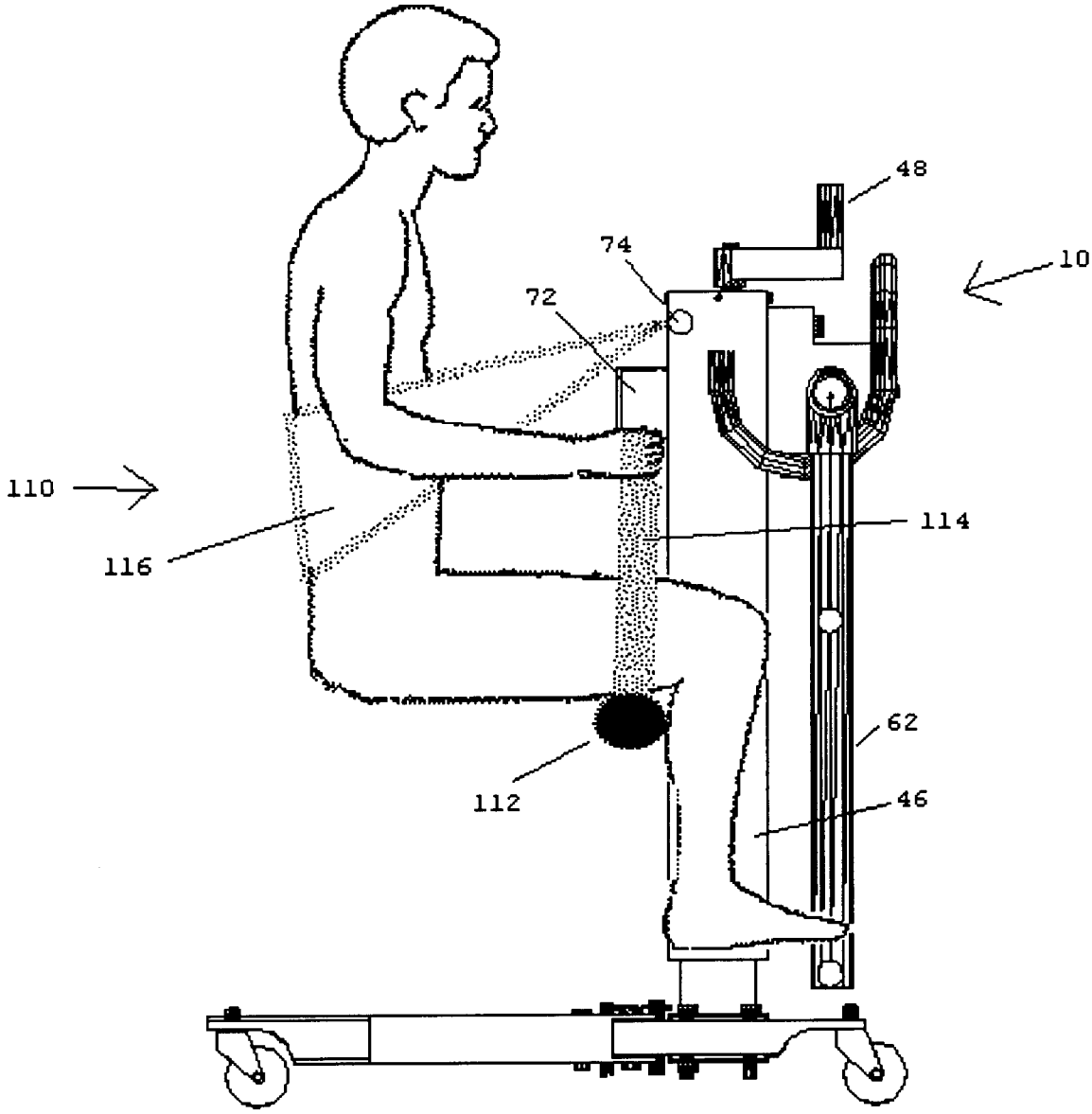
FIG. 5 is a side view of the "two-piece" patient support.

FIG. 5 shows a perspective view of the two-piece patient support 110, which consists of a foam-covered rigid thigh support 112 through which passes thigh support strap 114. A separate back support 116 attaches to the outer column using patient support connectors 76.

Operation of Preferred Embodiment—FIGS. 1–7

The lift 10 is intended to be used with the assistance of a single person (referred to here as a female "attendant") who would like to help a person who cannot stand (referred to here as a male "patient") to move from one location to another. While the lift can be used to move the patient to and from various locations, the examples used here are as follows: 1) the patient is initially supine on a bed, and his desired position is sitting in a wheelchair, and 2) the patient is initially seated in a wheelchair and the desired location is a commode.

Figure 4:
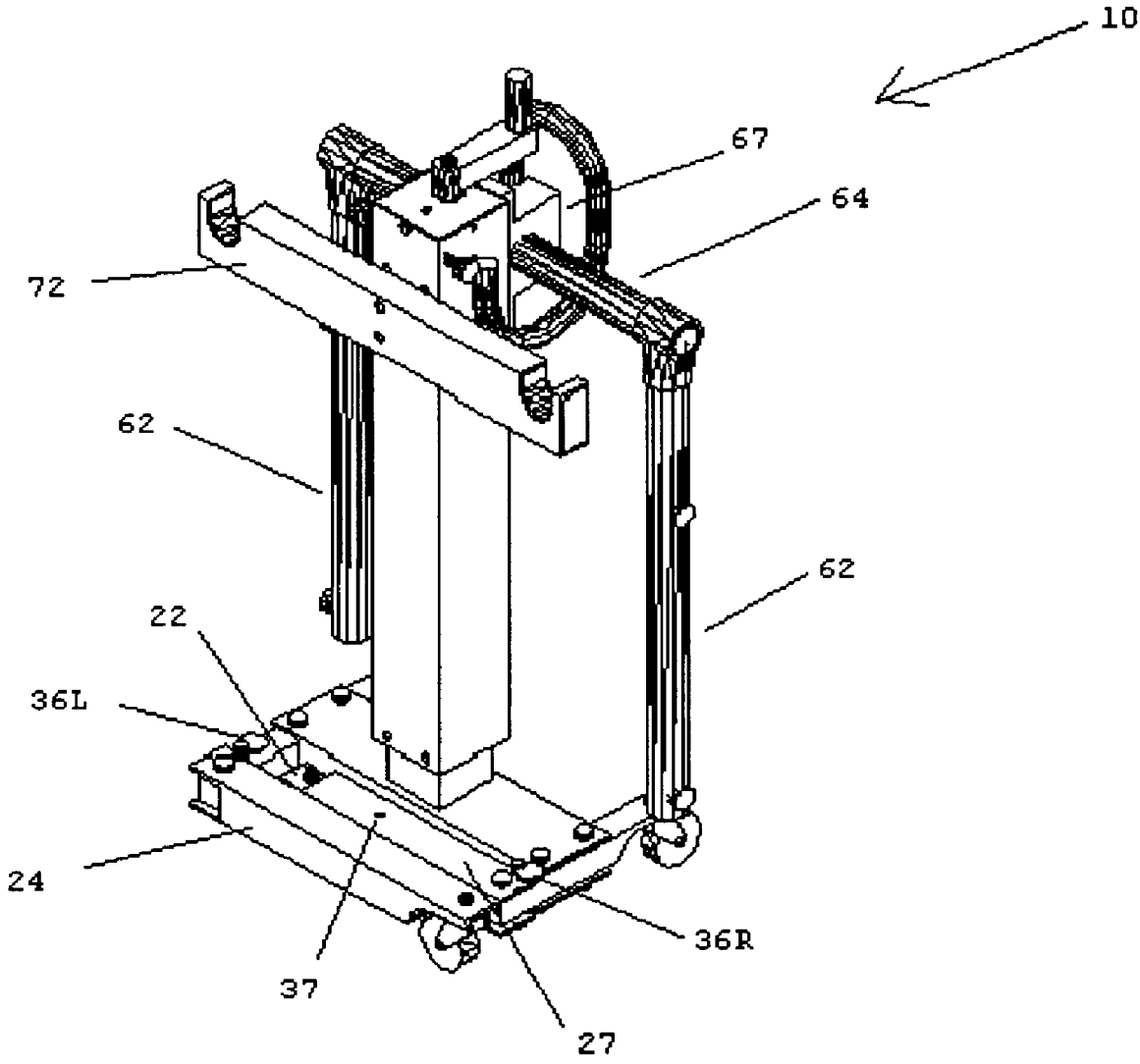
FIG. 4 is a perspective view of the invention in its compact configuration.

Assuming the lift starts out in its compact configuration, as shown in FIG. 4, the attendant opens it as follows:

1) unlock the left leg 24 by removing locking pin 36L, and pivot it 90 degrees to its opened position where it will be locked into place by replacing locking pin 36L;
2) unlock the right leg 27 by removing locking pin 36R, and pivot the right leg 27 90 degrees to its opened position where it will be locked into place by replacing locking pin 36R;
3) pull out the telescoping leg 22 to its full length where it will be locked into place by snap button 37;
4) unlock the arms 62 by releasing locating pin 67 in pillow block bearing 76 and pivot the arms approximately 270 degrees to its open position where they are supported by crossbar 72. After these steps have been completed, the lift is in its opened configuration, as shown in FIG. 1B.

In each transfer described below, the lift is assumed to be initially opened and ready for use.

Transfer from Supine on Bed to Sitting in a Wheelchair—FIGS. 1, 3

For this transfer, the patient must first be brought to a position whereby he is sitting on the seat sling 100 at the side of the bed with his legs over the edge. To accomplish this, the attendant lays out the sling (FIG. 3) next to the patient's hips near the edge of the bed, with its straps 104 parallel to the bed's edge. She then helps the patient into a seated position using the recommended and commonly taught method of rolling the patient onto his side and then swinging his legs over the edge of the bed near the sling. The patient's torso is then raised to bring him to a sitting position on top of the sling 100 at the edge of the bed.

The attendant uses the crank 48 (FIG 1D) to raise or lower the outer column 46 so that the top-section's arms 62 are at a height that is appropriate for attachment of the sling 100 to the lift's patient support connectors 74.

The attendant now rolls the lift towards the bed, with the open side of the u-shaped base facing the bed. Her objective is to bring the outer column 46 as close to the bed as possible. With the lift in position, the seat sling 100 already underneath the patient can be attached to the patient support connectors 74. Note that as the sling straps 104 pass freely through the loops 103 in sling cloth 102, there is no need to insure that the patient is perfectly centered on seat sling 100 to avoid tipping the patient when the lift is raised. Neither is it necessary to adjust the length of sling straps 104. Additionally, back strap 108, being integrated with seat sling 100, is automatically positioned behind the patient. This greatly simplifies one of the most cumbersome aspects of prior art patient lifts, which is the adjustment of the patient to the sling. This reduces the training required to use the lift and the time required to perform the transfer.

With the sling attached to the lift, the attendant then turns the crank 48 to raise the patient up off the bed. The counterbalance spring 41 supports most of the weight of the patient. The counterbalance spring is a novel feature with several significant advantages over the prior art, including greatly reduced effort required to raise the patient. It also allows for a higher pitch and smaller diameter lifting screw than would otherwise be required, which reduces the number of turns required to raise the lift and allows for significantly faster transfers and lighter weight. With the patient off the bed, the lift and patient can be rolled by the attendant away from the bed and towards the wheelchair. During this transfer, the patient is oriented on the lift as shown in FIG. 1D. Referring to FIG. 1D, it should be noted that the patient and lift are effectively intertwined, with his knees surrounding the lifting column and the lifts' arms surrounding the patient. This results in several significant advantages. Firstly, the patient has a sense of "wearing" the lift, giving him a strong sense of security and stability. Secondly, the patient is transferred in a very natural, comfortable and dignified posture, greatly reducing his reluctance to use the lift or to be seen in it in public. Thirdly, the crank 48 is accessible to the patient as well as the attendant, thus allowing the patient to assist and participate in his transfer if desired. This reduces his sense of helplessness and increases his sense of control, while also speeding and facilitating the transfer process. Fourthly, the inter-twined nature allows for a small base, since it places the patient's center of gravity close to the lifting column while the arms, surrounding the patient, prevent his center of gravity from shifting side-to-side. This allows the base to be surprisingly small, approximately 16 in wide and 26 in long, while maintaining sufficient stability. This greatly improves its maneuverability in confined spaces, a major limitation of the prior art. Fifth, the placement of the center of gravity near the lifting column reduces the mechanical stresses on the lift, allowing it to be constructed from light-weight tubing. It is therefore possible to support patients weighing several hundred pounds using a lift that weighs only approximately 35 pounds. This allows the lift to be easily transportable.

Figure 1C:
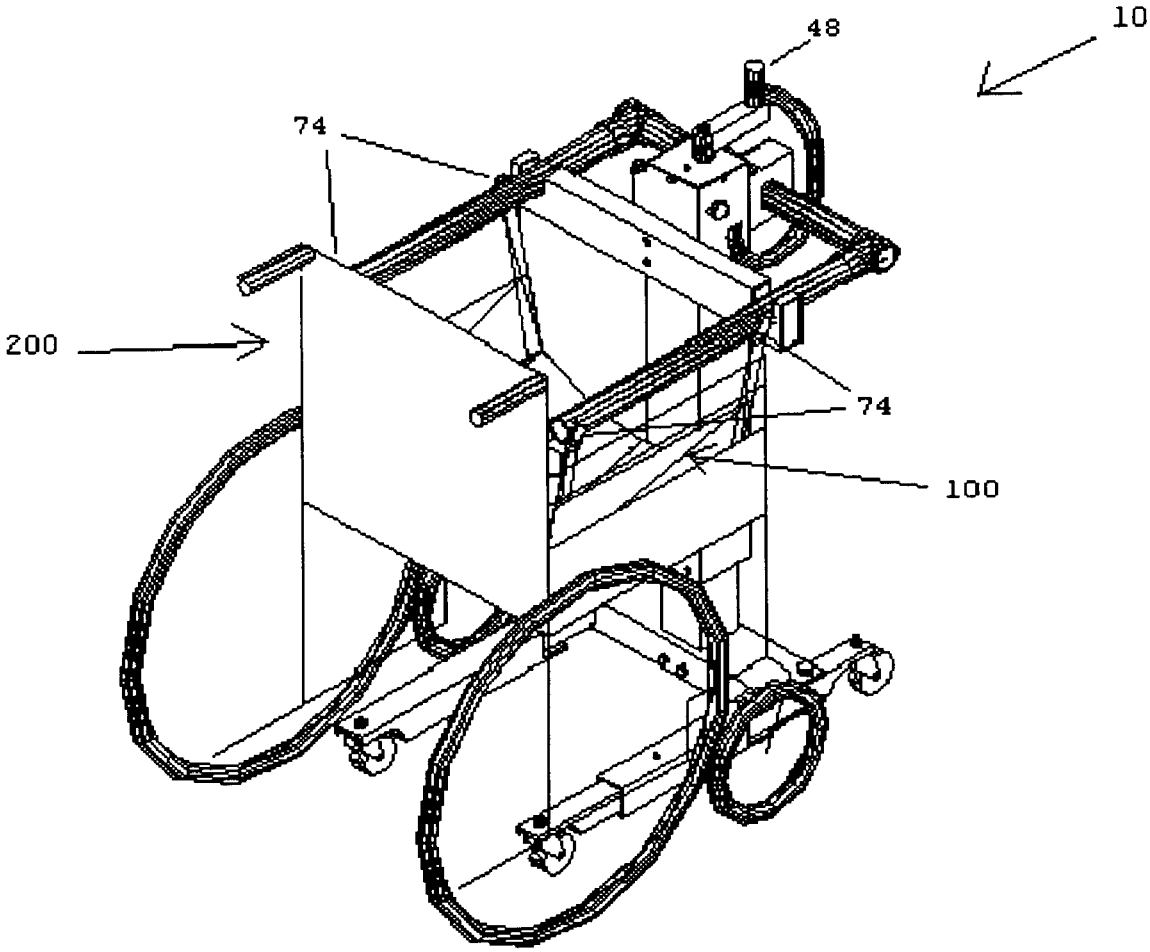
FIG. 1C is a perspective view of the invention positioned in front of a wheelchair.
Figure 1D:
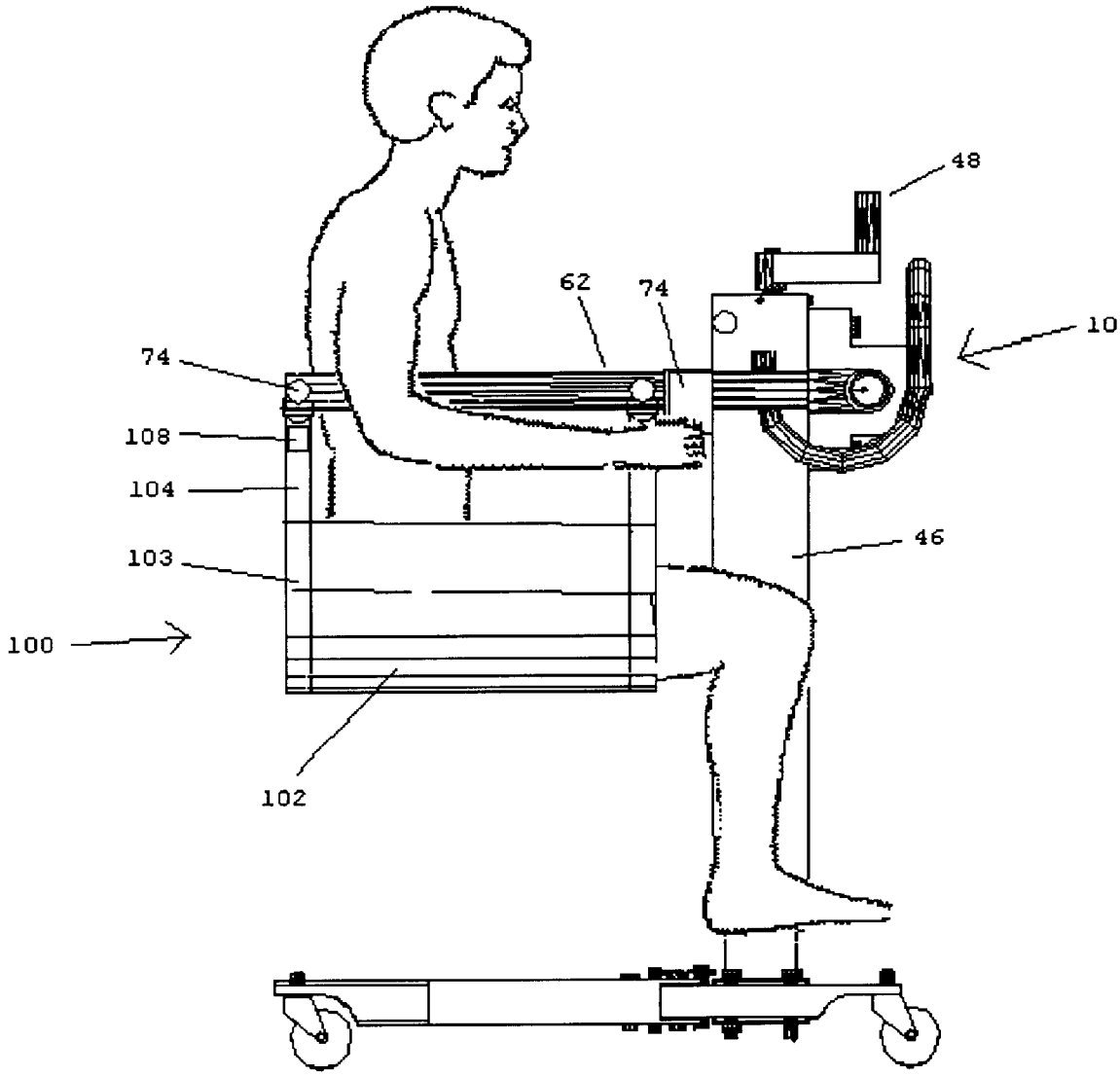
FIG. 1D is a side view of the invention showing a patient seated in the lift.

To move the patient onto the wheelchair 200, the lift is brought to the position shown in FIG. 1C. The wheelchair's foot supports can be pivoted either upwards or outwards to provide clearance for bringing the lift to this position. Once the lift is properly positioned at the wheelchair, the unloading of the patient can begin. This is accomplished by turning the crank 48 to lower the patient onto the wheelchair's seat and detaching the sling 100 from the patient support connectors 74. The lift can then be rolled away from the wheelchair. The patient is left sitting in the wheelchair with the detached sling 100 underneath him, where it remains for use in subsequent transfers.

Transfer from a Wheelchair to a Commode—FIG. 5

In transferring to a commode for toileting purposes, it is desirable to have access to the patient's clothing and undergarments. This can be accomplished through the use of an alternate two-piece patient support 110, shown in FIG. 5. To effect the transfer, the arms 62 may be rotated to their closed position. Thigh support 112 is placed under the patient's thighs, and thigh support strap 114 is looped over each end of crossbar 72. The back support 116 is then slid behind the patient's back and attached to patient support connectors 74. The patient may then be raised by turning crank 48. The rigid nature of the thigh support 112 pressing against outer column 46 prevents the patient from swinging forward and maintains him in a predominantly sitting position. The lift may then be rolled to position the patient over the commode, where clothing may be removed without interference from the sling. Note that since the arms 62 are not required for this transfer, the patient's arms are free to assist with disrobing and clean-up. It is therefore possible for the attendant to leave the room, affording the patient privacy to disrobe. The patient can then turn crank 48 himself to lower himself onto the commode. When finished, he can turn crank 48 to raise and clean himself and re-position his clothing before calling the attendant to roll him back to the wheelchair. This feature affords the patient an additional degree of dignity not available with the prior art, and also allows the lift to be used in public restroom stalls.

This completes the descriptions of the example transfers that have been used to illustrate the operation of the lift. Note that these examples are not intended to be all-inclusive—i.e., other types of transfers besides those illustrated can also be accomplished using the lift, such as transferring to or from a car seat.

In addition to its versatility, the lift's compactness and portability are also significant advantages. Operations related to these features of the lift are discussed in the following subsection.

Closing the Lift—FIG. 4

After the lift has been used, it can be returned to its compact configuration, shown in FIG. 4, by performing the following four steps:

1) Rotate the arms 62 about pivot block bearing 76 270 degrees until they are in a vertical orientation. In this position, locating pin 67 will automatically engage a hole in handlebar 64, locking it in place.
2) Depress snap button 37 and push telescoping leg 22 into right leg 27
3) Remove locking pin 37R from right leg 27, and pivot the right leg inward 90 degrees, locking it in place with locking pin 37R.
4) Remove locking pin 37L from left leg 24, and pivot the left leg inwards 90 degrees, locking it in place with locking pin 37L.

Figure 6:
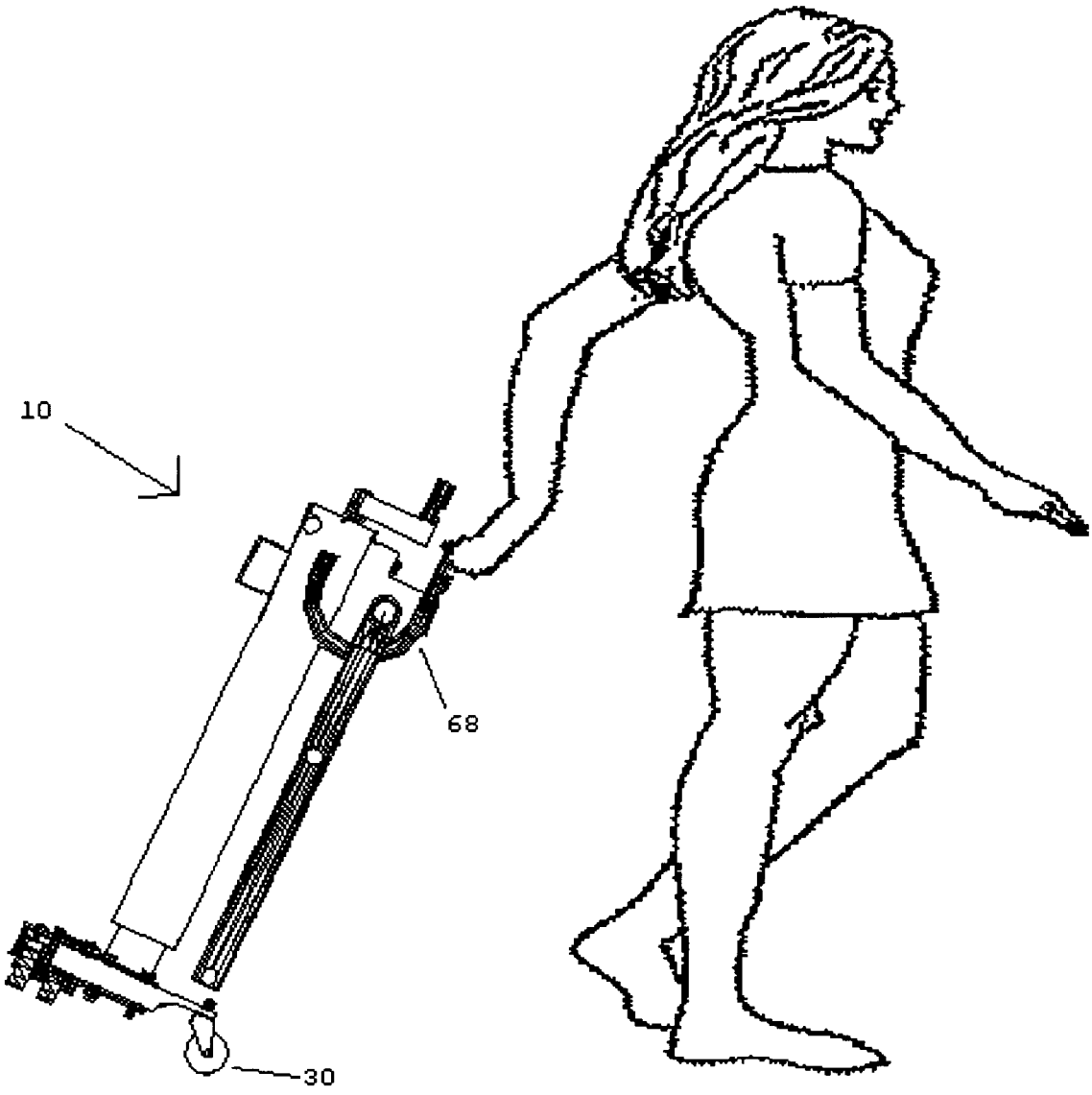
FIG. 6 is a side view of the invention in its compact configuration being rolled by an attendant.
Figure 7:
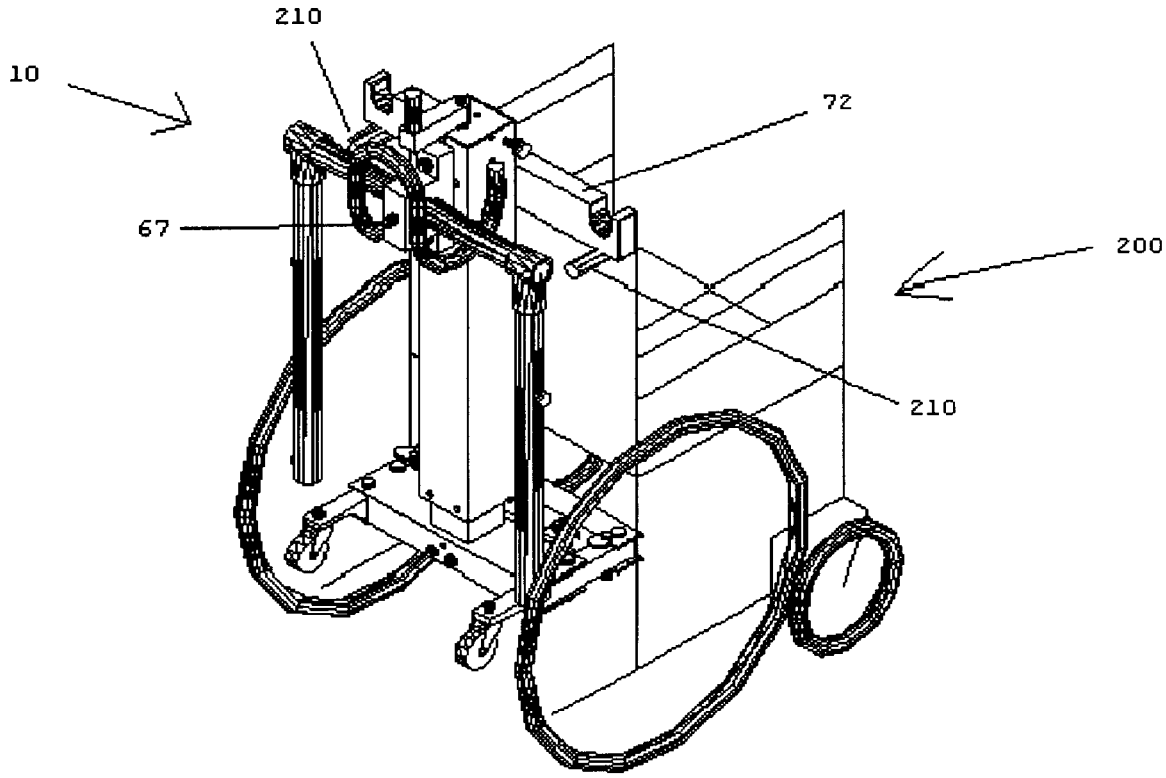
FIG. 7 is a rear perspective view of the invention showing the lift mounted on the back of a wheelchair.

Transporting the Closed Lift—FIGS. 1, 6, 7

While the lift is not too heavy for most people to carry, it will often be convenient to transport the lift by rolling it along using the front casters 30. FIG. 6 illustrates this method of transporting the closed lift. The figure shows an attendant on the same side of the lift 10 as the front casters 30. Gripping the handle 68, she has tilted the lift so that it is supported on the floor only by the front casters 30. She is then able to roll the lift along behind her, as is commonly done with a piece of rolling luggage.

In its compact configuration the lift occupies a volume of only approximately 16 in wide×13 in deep by 37 in tall and weighs approximately 35 pounds and can therefore be easily transported in a car trunk or stored in a closet. If necessary for shipping or to further facilitate transport, the lift may be readily broken down into it's three component assemblies. With reference to FIG. 1B, lifting column 40 may be detached from base 20 by pulling mounting pins 45 and slipping lifting column 40 up and out of its recess in base axis 26.

The lift 10 can also be moved together with a patient in a wheelchair 200 by supporting the lift on the back of the wheelchair. FIG. 7 shows how this can be done, with the lift's crossbar 72 positioned atop the wheelchair's handgrips 210. This feature represents a significant advance over the prior art, as it allows the lift to be available at all times, without requiring modification of the wheelchair. This allows for faster transfers, since it is not necessary to locate a lift before a transfer can be done. It also prevents injury by avoiding the manual transfers necessary when a lift is not available. This feature is a further consequence of the small size made possible by the "inter-twined" nature of the lift and the patient, as described above when FIG. 1D was discussed.

Figure 8:
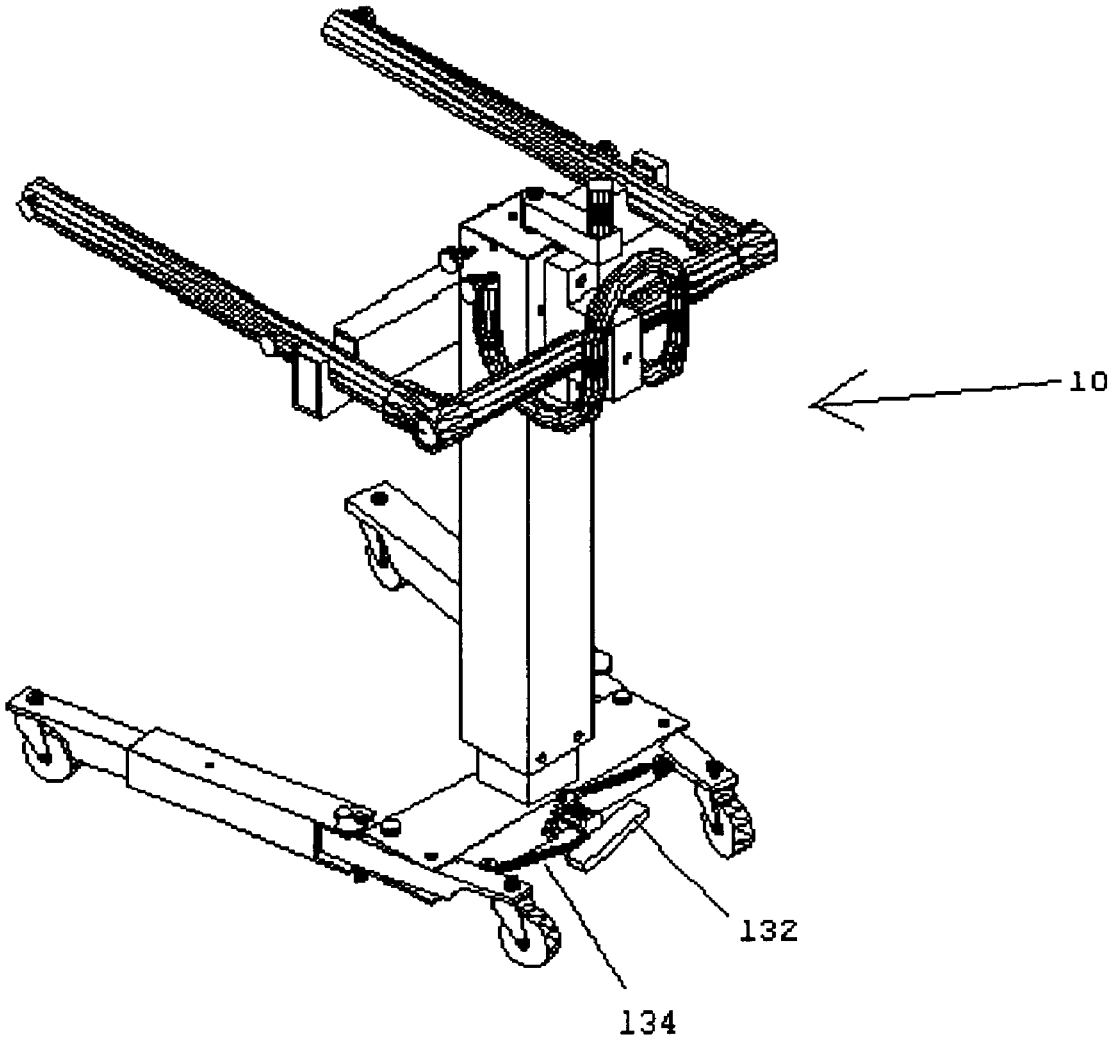
FIG. 8 is a rear perspective view of a spreading base alternate embodiment.

Alternative Embodiments—FIG. 8

The preferred embodiment of the lift illustrated in FIGS. 1 though 7 can be altered in a variety of ways without changing the scope of the invention.

It is possible, for example, to make the base axis width adjustable, either manually or with a motor-driven actuator, to maintain compactness while allowing for a wider spread when necessary. FIG. 8 demonstrates a spreading base design, to facilitate lifting patients from floor level with patients oriented facing the lift, or for using the lift as a walker. The legs can be re-oriented forward for passing through narrow doorways.. Stepping on foot pedal 132 causes linkage 134 to rotate the legs inward. Various methods may be used to lock the legs in either the spread or narrow configuration. One variation would use a spring-return pneumatic cylinder to bias the legs into a normally spread orientation. A valve could then be closed via a hand switch on the handlebar, effectively sealing the pneumatic cylinder and preventing the legs from spreading as long as the hand lever is depressed. This would be a way of insuring that the legs were in their narrow orientation only when an attendant had her hands on the lift. Many other means are possible.

The above-mentioned alternative embodiments illustrate that various aspects of the lift can be changed without changing the scope of the invention. Many different configurations of the lift are possible, and the variations mentioned above are not intended to be all-inclusive.

SUMMARY, RAMIFICATIONS, AND SCOPE

Accordingly, the reader will see that the compact portable patient lift of this invention can be used to transfer patients in a comfortable and dignified manner between chairs, wheelchairs, beds, cars and other surfaces of varying heights, affording patients increased mobility both at home and outside and allowing them an increased quality of life. The compact nature of this lift allows it to be used in confined spaces. Additional advantages of this lifts' small size include:

- light weight;
- ability to be stored compactly without disassembly;
- ability to be transported easily between locations by rolling like a piece of rolling luggage, or placing into a car trunk;
- ability to be transported with a patient by mounting onto a standard wheelchair so as to be readily available at both initial location and final destination.

Additional advantages of this invention are its ease of use, faster transfer time, and reduced level of training required. The lift also affords the patient the opportunity to participate in his transfer, increasing his degree of control, self reliance and dignity. The lift is also relatively economical to manufacture and therefore affordable for home use.

While the description above contains many specificities, these should not be construed as limiting the scope of the invention but as merely providing illustrations of some of the presently preferred embodiments of this invention. Many other variations are possible. For example, the lifting column can be folded downward rather than folding the legs inward.

Several alternatives for the lift's base are possible. For example a spring plunger whose plunger mates with locking groove 25 of FIG. 1B could replace the locking pins 36 mounted into leg supports 21 and 23. Depressing the plunger with one's finger would disengage the plunger from the groove, allowing the leg to be pivoted about fold axis pin 34. The plunger would then automatically extend and mate with locking groove 25 when one of the grooves is moved into alignment above the spring plunger.

A fold-up c-shaped base could be used instead of the u-shaped base shown in the preferred embodiment. Also, the lift's base could be made so that the legs fold to the vertical plane rather than the horizontal plane. This can be done for either the u-shaped base design or a c-shaped one. Alternatively, both legs could be telescoped, providing a degree of compactness without folding. The base could also be made larger so that the wheels of a wheelchair fit between its legs, or the base may be made a fixed size, without folding. Although this results in a loss of compactness, it might be desirable for certain applications.

It might be desirable to motorize the base, so that it could be maneuvered by the patient himself, eliminating the need for an attendant.

With respect to the mid-section 40, different types of jacks could be used for raising and lowering the outer column 46. For example, a pneumatic, hydraulic or electric cylinder could be incorporated in place of the manually-driven actuator described in the preferred embodiment. In the case of a battery operated electric actuator, use of the gas spring 41 serves to conserve battery power, allowing for many more transfers before recharging is required. However, an actuator may be used without the gas spring as well.

Other embodiments might include replacing the tubes of the columns, legs, arms and supports with tubes of other cross-sectional shape. Other types of brakes may be used to prevent back-driving, or other pitch screws, or pre-loaded nuts, could be used to eliminate the need for a brake. Ball screws could be used to minimize friction.

The top-section 60 could also be modified in a number of ways. One possibility is to make it such that the arms 62 pivot individually rather than together. As another example, rather than having two arms 62, an alternative top section design meant for use with different types of patient support means could have only one central arm. The arms or top section could be eliminated entirely, using patient support means that attach directly to the lifting column. It is also possible for the top-section to be closed using a 90 degree pivot downwards towards the mid-section rather than a 270 degree pivot. Folding of the arms in the horizontal plane is another alternative.

A variety of patient support means can be used in conjunction with the lift, including various styles of slings and different styles of rigid seats, as well as knee support pads. Various types of upper-body support means could also be incorporated, such as chest supports or supports for underneath a patient's armpits.

The number, locations, and nature of the patient support connectors 74 can also be changed in alternative embodiments. The back-strap 76 can also be changed—for example the back-strap could be made wider and thicker for increased support.

With alternative types of patient support means that can be fitted to the patient and removed from him while he is in a seated position, the operation sequence would be altered accordingly. In particular, the patient support means would not need to be positioned prior to sitting the patient upright, nor would it need to remain underneath the patient after transfer was complete.

Thus the scope of the invention should be determined by the appended claims and their legal equivalents, rather than by the examples given.

What is claimed is:

1. A patient transfer device comprising:

a) a horizontally disposed base frame comprising a pair of legs attached to a base axis, said base frame having wheels mounted thereunder for enabling said base frame to roll along a surface, b) a substantially vertically disposed lifting column mounted to said base axis, c) a power means for raising and lowering said lifting column, d) a patient support means secured to said lifting column, said patient support means comprising a substantially horizontally disposed support bar attached at its midpoint to the patient side of said lifting column and further comprising a pair of substantially horizontally disposed patient support arms parallel to said legs, said support arms being pivotally mounted to the other side of said lifting column and supported by said support bar, whereby said support means may be rotated into a compact configuration, and whereby said patient transfer device may then be suspended on a standard wheelchair by said support bar.

2. The apparatus of claim 1, wherein said power means comprises a counterbalance means which supports a significant portion of a patient's weight.

3. The apparatus of claim 2, wherein said counterbalance means comprises a gas spring.

4. The apparatus of claim 1, wherein said legs comprise a substantially vertical pivot axis near said base axis allowing said legs to be folded towards each other in a horizontal plane so as to overlap, resulting in a compact configuration of said patient transfer device.

* * * * *